US005806625A

United States Patent [19]

Katz

[11] Patent Number: 5,806,625

[45] Date of Patent: Sep. 15, 1998

[54] RELEASABLE TREE STEP HOLDER AND METHOD OF ANCHORING CLIMB FACILITATING TREE STEPS

[75] Inventor: Roger Katz, Boyne City, Mich.

[73] Assignee: Scott Hancock, Elmira, Mich.

[21] Appl. No.: 757,500

[22] Filed: Nov. 27, 1996

[51] Int. Cl.[6] ..... A63B 27/00

[52] U.S. Cl. ..... 182/92; 182/129

[58] Field of Search ..... 182/92, 129; 7/167; 81/489, 487, 438

[56] References Cited

U.S. PATENT DOCUMENTS

| | | | |
|---|---|---|---|
| 798,325 | 8/1905 | Daddysman, Jr. . | |
| 1,095,851 | 5/1914 | Grafton | 81/489 |
| 1,743,505 | 1/1930 | Tugeon | 81/438 X |
| 2,920,517 | 1/1960 | Willey, Jr. . | |
| 3,274,864 | 9/1966 | Chapman . | |
| 3,295,459 | 1/1967 | Bergsten | 182/92 |
| 3,298,459 | 1/1967 | Bergsten . | |
| 3,850,056 | 11/1974 | Allen | 81/438 |
| 4,413,706 | 11/1983 | Michael | 182/92 |
| 4,449,612 | 5/1984 | Southard . | |
| 4,669,575 | 6/1987 | Skyba . | |
| 4,697,669 | 10/1987 | Bergsten . | |
| 4,749,251 | 6/1988 | Moulin . | |
| 4,756,181 | 7/1988 | Appelgren . | |
| 4,775,030 | 10/1988 | Wright | 182/92 |
| 4,867,272 | 9/1989 | Troubridge . | |
| 5,012,624 | 5/1991 | Dahlgren . | |
| 5,269,395 | 12/1993 | Lyzhoft | 182/92 |
| 5,279,388 | 1/1994 | Laughlin et al. . | |

OTHER PUBLICATIONS

Woods–N–Water News, Nov. 1995 Publication p. 29, Amerisstep Tree Step Installer (not prior art).

*Primary Examiner*—Alvin C. Chin-Shue
*Attorney, Agent, or Firm*—Learman and McCulloch

[57] ABSTRACT

A method of applying a tree step, having a step part and a tree penetration part connected by a web or shank, to a tree or post or the like utilizing a novel holder-applicator assembly which has inner and outer telescopic members movable relatively from a load position in which the inner member extends forwardly from the outer member to enable loading of the tree step web and step part to the inner member to a rearward position in which the tree step is captured by the outer member. The inner member is first telescopically forwardly extended to a load position and the tree step is loaded to the inner member with the web parallely received in the inner member and with the step part and tree penetrating part extending in opposite lateral directions from the inner member. Then the inner and outer members are relatively moved to a position in which the tree step is rigidly captured by the outer member and the holder-applicator is manipulated to move the tree penetration part of the step into the tree or post and anchored in position. Finally, the inner member is returned forwardly and the holder-applicator is removed from the anchored tree step.

16 Claims, 10 Drawing Sheets

RELEASABLE TREE STEP HOLDER AND METHOD OF ANCHORING CLIMB FACILITATING TREE STEPS

BACKGROUND OF THE INVENTION

The present invention relates to a device which can be used by bow hunters and others who are interested in progressively attaching climb assisting steps to a tree as they move up the trunk of the tree. Typically, such conventional Z-shaped steps are attached to both sides of a tree in a progressive manner as the climber moves upwardly to a perch in the tree.

Various tree steps have been applied previously, as demonstrated is the following patents: U.S. Pat. Nos. 3,298,459; 4,413,706; 4,449,612; 4,669,575; 4,697,669; 4,867,272 and 5,279,388. Typically, the aforementioned patents are of the type wherein the tree step includes the handle part thereof which facilitates its threading into the tree. Recently, the inventor has become aware of a releasable applicator device which can be used to anchor a conventional, more inexpensive tree step in place, and then removed from the tree step to anchor another tree step in position. In this device, the tree step is held in place by a set screw which, with use, is easily loosened such that the step and its applying device separate. Further, since threading of the tree step into the tree is usually initiated by using the applying device as a holder to hammer the end of the screw into the trunk of a tree, it is apparent that the device in question is not well suited to use when such steps are to be anchored in hardwood trees such as oaks, maples and the like, which are frequently the safest trees in which to anchor tree steps and build a hunting platform.

SUMMARY OF THE INVENTION

In accordance with the present invention, the combination tree step holder and applicator is telescopic in nature and has several positions. These positions include an initial position in which an inner sleeve member is extended from an outer sleeve member in the first place to provide an elongate socket in which the cross bar of the Z-shaped insert is received. The inner sleeve is then retracted to a second retract position within the outer sleeve in which the outer sleeve functions with the inner sleeve to rigidly lock the step in a position to be initially hammered into hardwood trees as well as soft wood trees. The outer sleeve is slotted to permit a laterally extending handle, which secures to the inner sleeve, to move with the sleeve, and the outer and inner sleeves in either position, are held in position by a suitable spring or other device. In the retract position the handle positively locks the inner and outer sleeves together and the end of the outer sleeve can be used as a second handle to jam the point of the tree step screw into the tree. The laterally projecting handle which secures to the inner sleeve for moving it back and forth, can be employed to spin the holder and its captured tree step to thread the tree step into the tree.

Typically the method of application of the tree step, then, involves operating the laterally extending handle to move the inner sleeve out of the outer sleeve to an extended position in which it can receive the Z-shaped tree step, then sliding the handle and inner sleeve in a retraction direction to securely grip the tree step and rigidly retain it in captured position between the inner and outer sleeves. The next step in the procedure of application is to grasp the handle end of the outer sleeve and, with a hatchet or hammer stroke, jam the screw end of the tree step initially into the tree trunk in a manner which penetrates the bark and tree sufficiently so that the screw is held by the tree. Thereafter, the laterally projecting handle is grasped to revolve the holder and tree step to thread the tree step into the tree. As a final step, the lateral handle is released to partially remove the inner sleeve from the outer sleeve once again to permit release of the applicator-holder from the anchored tree step. As indicated, the method further includes progressively applying tree steps as the climber moves up the tree to support his or her weight on the tree steps previously applied as additional tree steps are secured in position.

One of the prime objects of the present invention is to provide a readily releasable tree step holder and actuator of rugged character which rigidly locks the tree step in position so that it can be jammed with the necessary force into hardwood trees, and which can then be used to manipulate the tree step to thread it into the tree.

Still another object of the invention is to provide a tree step applicator which positively locks the tree step in position and does not depend on set screw fastening which can loosen and permit separation of the applicator and tree step when the tree step is attempted to be hammered into the tree.

Still another of object of the invention is to provide a tree step applicator which is of highly durable construction and not subject to wear which interferes with its operation.

Still another advantage of the invention is to provide a tree step applicator which can be released with one hand and operated by either hand safely from an elevated position on the tree trunk.

Other objects and advantages of the invention will become apparent with reference to the accompanying drawings and the accompanying descriptive matter.

THE DRAWINGS

The presently preferred embodiment of the invention is disclosed in the following description and in the accompanying drawings, wherein.

DETAILED DESCRIPTION

Figure 1:
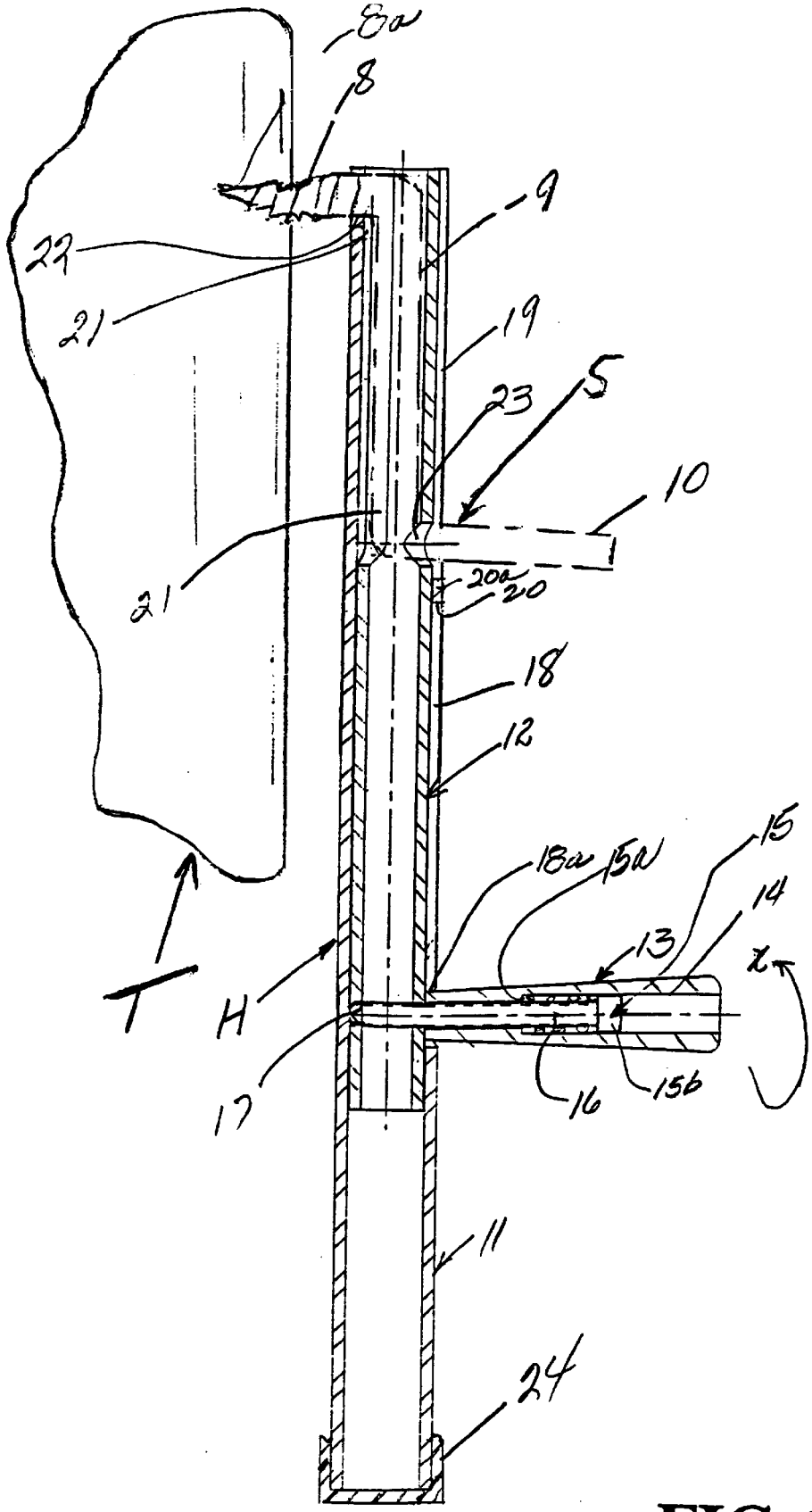
FIG. 1 is a sectional side elevational view of the applicator shown in the process of applying a Z-shaped tree step (in phantom lines) to the trunk of a tree.

Referring now more particularly to the accompanying drawings and in the first instance to FIG. 1, 2, and 7–10, particularly, it is to be understood that the conventional Z-shaped step generally designated S, which is to be anchored in the tree generally designated T, includes a threaded arm 8, with a pointed end 8*a*, connected by a shank portion 9 to a foot or step portion 10 which will support the foot and weight of the hunter or climber, once the portion 8 is fully threaded into the tree T. The step S is a strong, rugged steel member which, in FIG. 1, is shown only partially threaded into the tree T.

The step holder and applicator device, generally designated H, includes an outer tube member 11 telescopically receiving an inner tube member 12. A laterally extending handle, generally designated 13, secures to the inner sleeve 12 and includes a bore 14 in which a bolt member 15 is slidably received. A coil spring 16 is provided between the head 15*b* of the bolt and the seat shoulder 15*a* of bore 14 to normally maintain the handle 13 in the position shown in FIG. 1 in which the step S shown in diagrammatic lines is securely held between the inner and outer sleeves 11 and 12. A countersunk recess 17 can be provided in the inner tube 12 to receive the inner end of bolt 15. The spring 16 functions to hold the handle 13 and the inner tube 12 in the retracted position shown in FIG. 1. In this position, the Z-shaped step member S is rigidly captured and the holder H can be readily used like a hammer to drive the end 8*a* of the threaded portion 8 of step S into the tree. Once this has been accomplished, the holder H can be rotated as a crank handle in the direction "x" to thread the end 8 into the trunk of the tree T.

In order to free the holder H from the step S, once the step S is securely anchored in the tree, and in order to insert the step S in position in the first place, it is necessary that the inner tube 12 be extended from the outer tube 11, as shown in FIG. 2, where again the step S is shown only in diagrammatic lines. To permit this extension, a slot or passage 18 is provided in the outer tube 11 (see FIGS. 1 and 7 particularly) to permit the bolt 15 and handle 13 to move forwardly or outwardly.

A second longitudinally aligned slot or passage 19 is also provided in the outer tube 11 to pass the step portion 10 of step S when the inner tube 12 is retracted, after having been loaded with a step S. The slot 18 extends to the stop surface 20 provided on outer sleeve bridging portion 20*a* between the slots 18 and 19, and the slot 19 extends all the way from the bridging portion 20*a* to the front end of outer sleeve 11.

Figure 2:
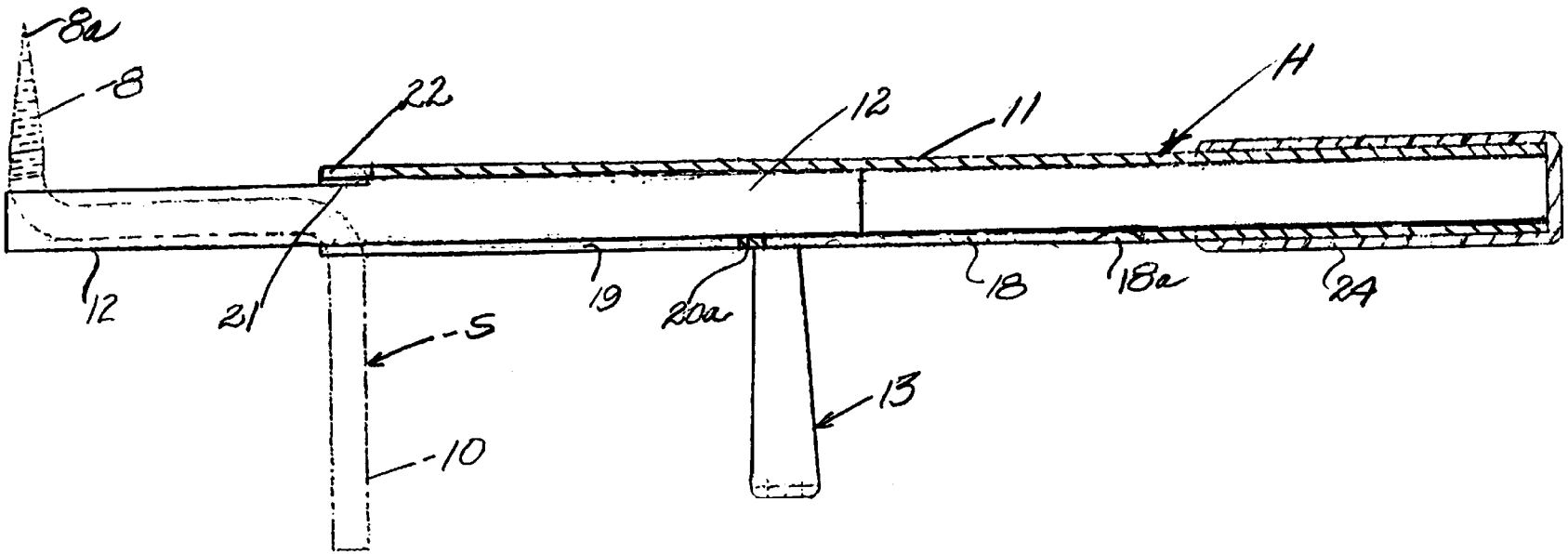
FIG. 2 is a sectional side elevational view showing the applicator-holder device operated to extend the inner telescopic sleeve to a position in which it can receive or release the tree step, which again is shown in phantom lines.

In the position of the parts shown in FIG. 1, step part 8 extends out through an elongate, longitudinally extending slot 21, provided in the inner sleeve 12 diametrically opposite the slot 19. Provided in the end of the outer sleeve 11 diametrically opposite slot 19, as shown in FIG. 2, is a recess or notch 22 out which the end 8 of the step extends when the sleeve 12 is in retracted position. An opening 23 is provided in inner sleeve 12 diametrically opposite slot 21 to permit the step portion 10 to extend outwardly from the holder H through the opening 23 and out slot 19 in outer sleeve 11. Preferably the lower end of outer sleeve 11 is covered by a handle grip 24, shown broken away in FIG. 1 and in solid lines in FIG. 2.

To release the step S, when the step S is in the captured position shown in FIG. 1, the handle 13 is pulled outwardly to disengage the inner end of handle 13 from the opening 18*a* (see FIG. 1) in outer sleeve 11 in which it is received in this position of the parts. This releases the outer sleeve 12 from the inner sleeve 11 so that the sleeve 11 can fall under the influence of gravity until wall surface 20 comes into engagement with the bolt 15. With the parts now in the FIG. 2 position, the entire holder or applicator can simply be moved in a direction "y" laterally away from the tree to leave the step S engaged in the tree. The handle return spring 16 holds the handle 13 and inner sleeve 12 in both of the positions shown in FIGS. 1 and 2 when it is permitted to do so by releasing the handle 13.

Figure 3:
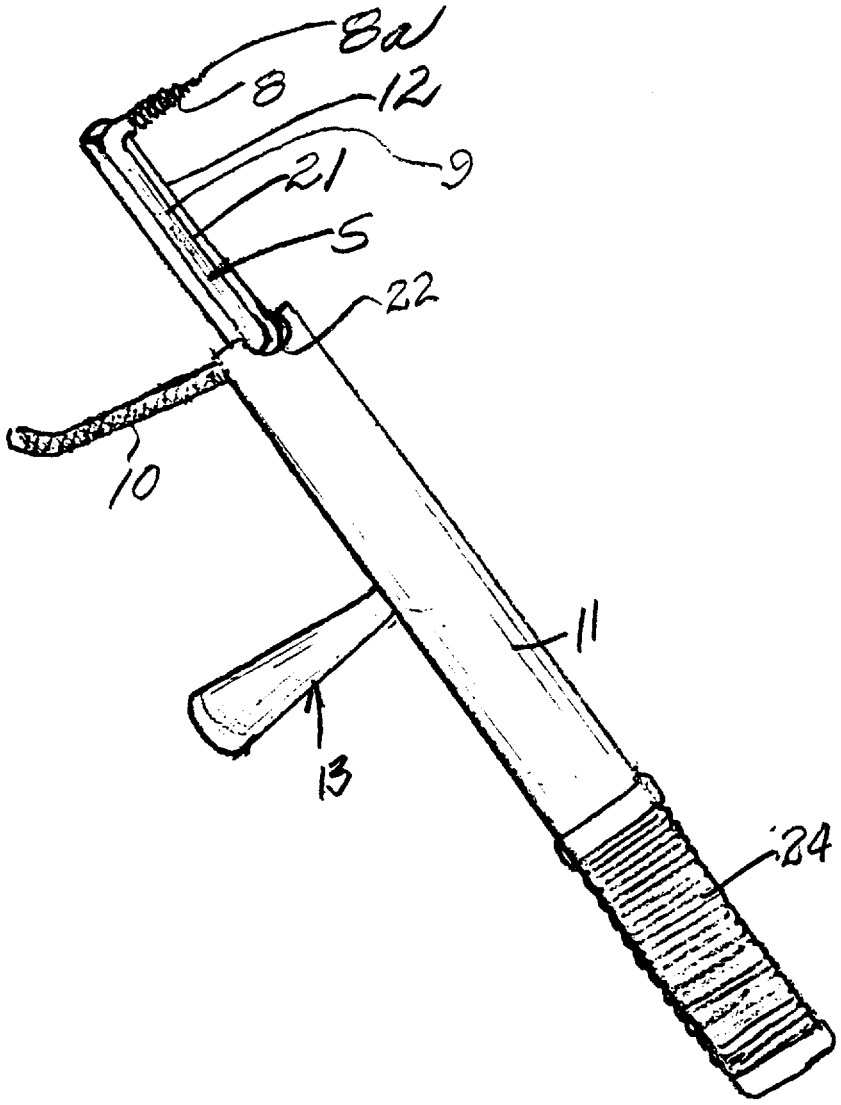
FIG. 3 is a perspective elevational view showing the Z-shaped tree step in a position in which it is receive and supported by the holder.

FIGS. 3–6 illustrate a new and improved method of use in which the relative telescoping of the inner and outer sleeves 11 and 12 provide novel steps which, to my knowledge, have not heretofore been performed. In FIG. 3 the step S is shown in the loaded but not captured position, also shown in more detail in FIG. 2. In this position of the sleeves 11 and 12, wherein the sleeve 12 extends outwardly or forwardly of the sleeve 11, the shank 9 of the step S is supported by the inner sleeve 12. It was readily inserted by inserting the step portion 10 through the opening 23 in inner sleeve 12 and out the slot 19 provided in the outer sleeve 11, the shank portion 9 traveling laterally inwardly to rest against and be supported by the extended inner tube 12 in the FIG. 3 position. To move the holder H to the FIG. 1 position in which the step S is rigidly captured between the inner and outer sleeves 11 and 12, it is merely necessary to pull outwardly on handle 13 against the compressive force of spring 16 while moving handle 13 inwardly or downwardly in FIG. 3 until it can be engaged within handle receiving opening 18*a* in the outer sleeve 11.

Figure 4:
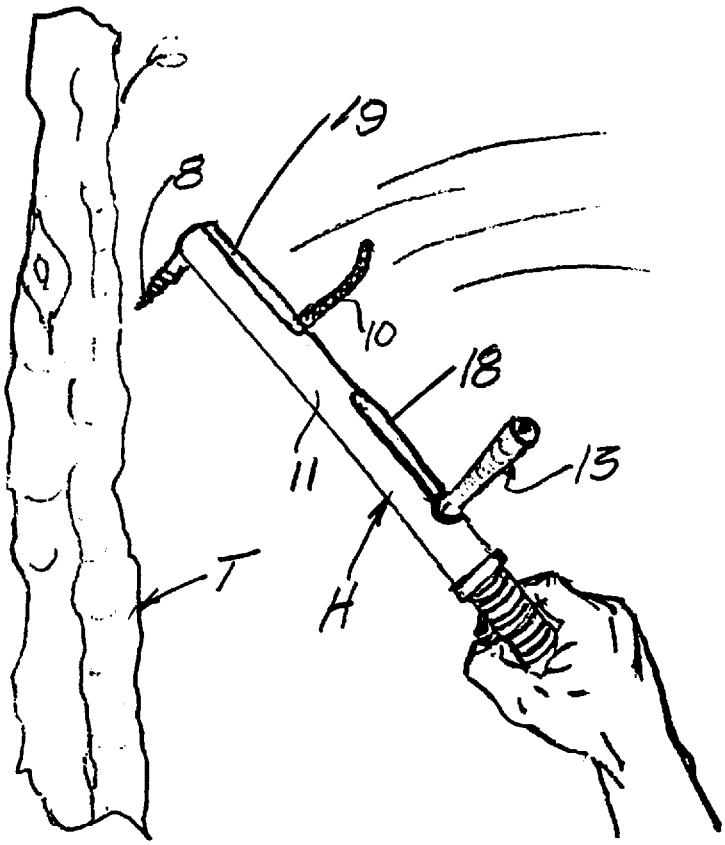
FIG. 4 is a perspective side elevational view illustrating the manner in which the applicator is used to initially hammer the point of the screw of the step into a tree.
Figure 5:
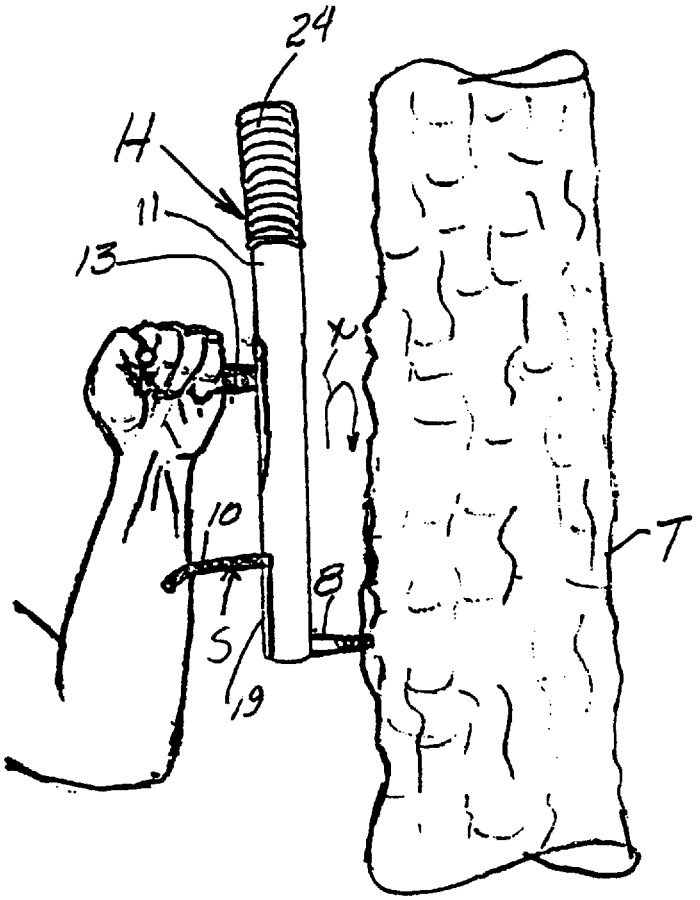
FIG. 5 is a similar view illustrating the manner of revolving the applicator and step to thread the step screw into the tree.
Figure 6:
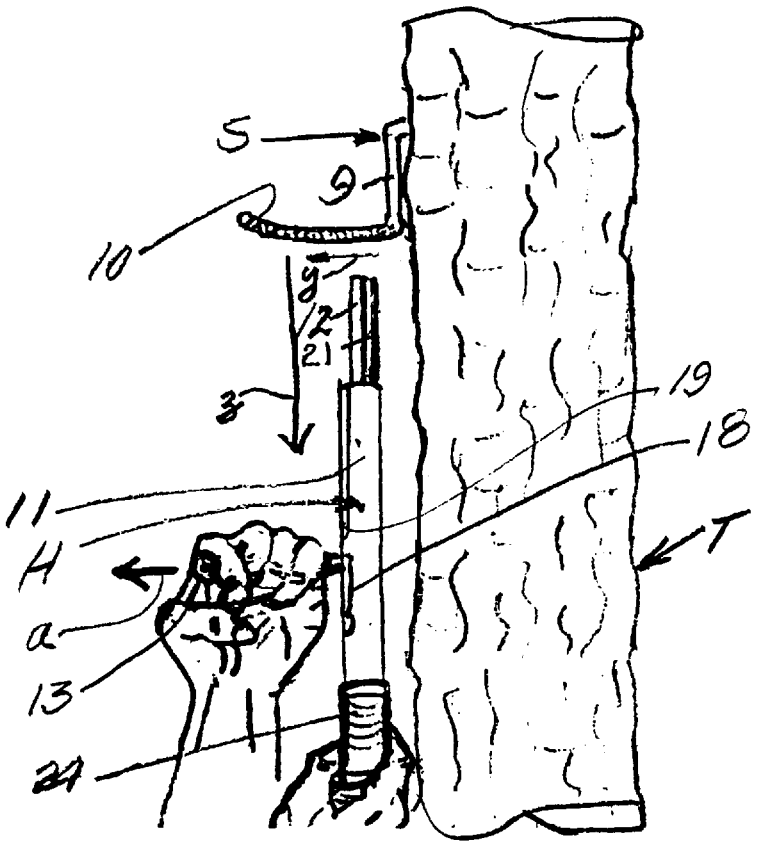
FIG. 6 is still a further similar view illustrating the manner of removing the applicator from the anchored step by restoring the inner sleeve to its outer position to permit release of the anchored step and dispose it in a position to receive the next tree step to be applied.
Figure 7:
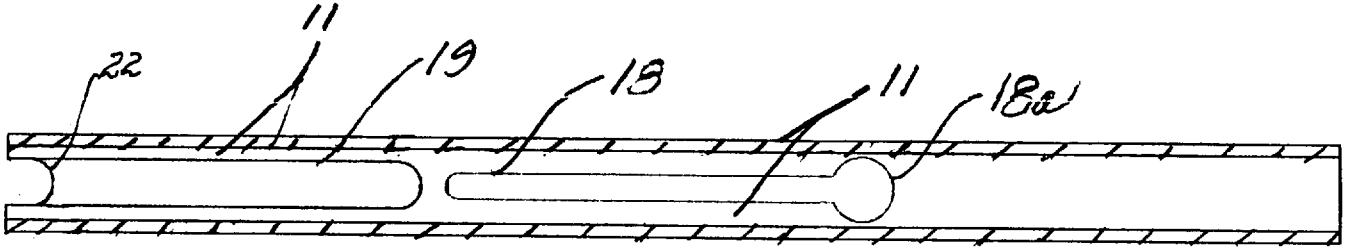
FIG. 7 is a sectional detailed side elevational view illustrating the outer sleeve of the applicator only.
Figure 8:
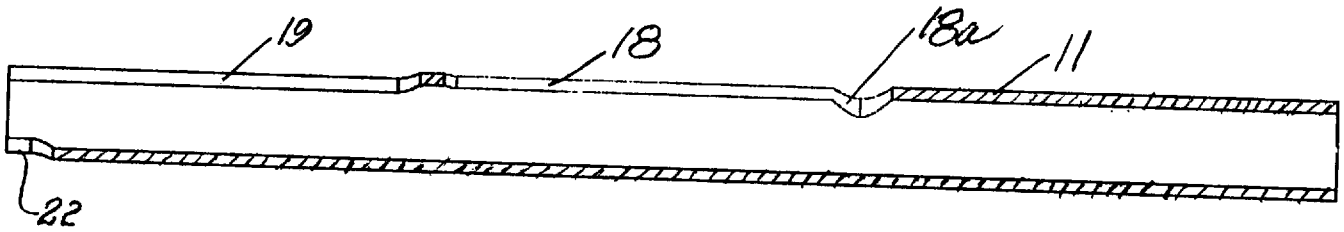
FIG. 8 is a sectional side elevational view of the outer sleeve in a rotated position.
Figure 9:
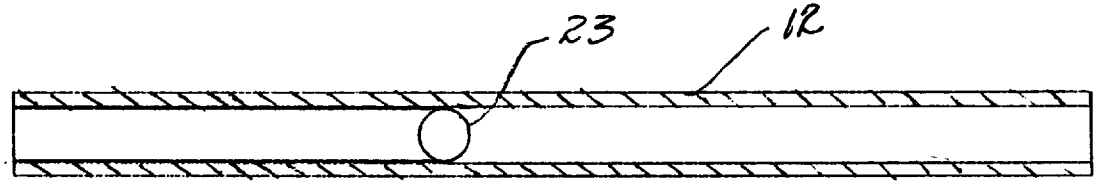
FIG. 9 is a sectional side elevational view of the inner sleeve.
Figure 10:
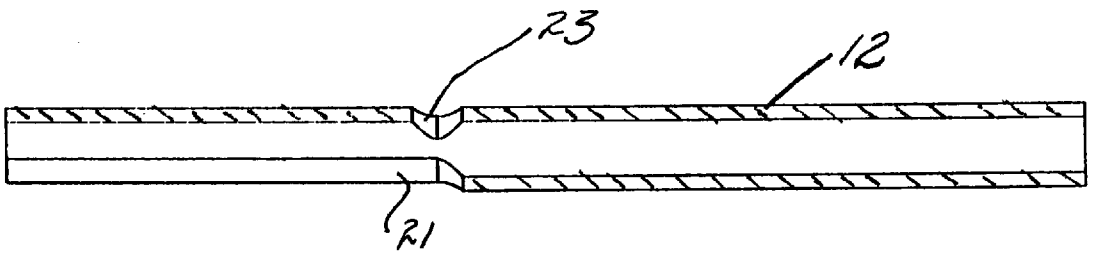
FIG. 10 is a sectional side elevational view of the inner sleeve in a rotated position.

In this position of the parts, the threaded end 8*a* can be hammered into the trunk of the tree in the manner illustrated in FIG. 4. Once in this position, the holder applicator H is revolved in a direction to thread the end 8*a* of arm 8 into the trunk of the tree, as shown in FIG. 5. Thereafter, as previously indicated, when handle 13 is pulled outwardly, as at "a" in FIG. 6, to a released position, and sleeve 11 is permitted to move downwardly to expose the upper end of sleeve 11, the holder H can be moved laterally as at "y" out away from the trunk to move the step portion 10 out of opening 23. Then the entire holder H can be moved downwardly in the direction "z" away from the anchored step S so as to be accessible to be reloaded with the next step S to be applied.

The invention is concerned with the method in which step S is rigidly captured between the inner and outer sleeves, as well as with the new method steps which are involved in its mode of manufacture and its mode of use.

The disclosed embodiment is representative of a presently preferred form of the invention, but is intended to be illustrative rather than definitive thereof. The invention is defined in the claims.

I claim:

1. A method of applying a tree step, having a step part and a tree penetration part, connected by a web to a tree, or post, or the like utilizing a holder-applicator assembly comprising inner and outer telescopically coupled members movable relatively axially from a load position in which the inner member extends forwardly of the outer member for loading of the tree step to the inner member to a rearward position in which the tree step is captured by the outer member; the steps of:

a. relatively axially moving the inner member to a load position in which it extends telescopically forwardly of the outer member;

b. loading the tree step to the inner member with the web parallely received therein and the step part and tree penetration part extending in opposite lateral directions from the inner member;

c. relatively telescopically moving the inner and outer members of the holder-applicator assembly to a position in which the tree step web is captured by the outer member;

d. manipulating the holder-applicator to fix the tree penetration part of the step into the tree or post and anchor it in position and;

e. returning the inner member telescopically forwardly and removing the holder applicator from the anchored tree step.

2. The method of claim 1 wherein the inner member is a sleeve having an elongate socket for receiving said tree step web and an opposed opening out which the step part extends, and said outer member is a sleeve telescopingly receiving said inner member which has an elongate slot in its front end for passing said step part, the step part riding in the outer member elongate slot when the parts are relatively moved to and from load position and the holder-applicator is removed from the anchored tree step by moving it laterally away from the tree to remove the web and step part from the inner member.

3. The method of claim 1 including the step of relatively locking the inner and outer members in telescoped position when the tree step is captured by the outer member.

4. The method of claim 3 including the step of relatively unlocking the inner and outer members when the tree step has been anchored in position.

5. In combination with a tree step having a step part and a tree penetrating part connected by a web to extend in opposite lateral directions, a releasable tree step holder-applicator comprising inner and outer telescopically coupled members moveable relatively axially from a load position in which the inner member extends telescopically forwardly of the outer member and is configured to receive the web and to pass the step part through it for loading of the tree step to the inner member to a telescopically rearward retention position in which the tree step is captured and retained by the outer member; the said outer member having an axially elongate passage in alignment with said web extending to the front end of said outer member for slideably passing the tree step part when the inner member moves relatively rearwardly to retention position.

6. In combination with a tree step for retaining and applying a tree step with a step part and an oppositely extending tree penetrating part connected by a web comprising: a holder assembly comprising inner and outer telescopic sleeve-like members mounted for movement relatively from a load position in which the inner member extends forwardly of the outer member for loading of the tree step to the inner member to a rearward retention position in which the tree step is captured by the outer member; the inner member having a wall portion with a slot for receiving the web and an opposed wall portion for retaining the web with an opening passing only the step part; the outer member having an elongated step part passing slot in alignment with said opposed wall portion extending to the front end of said outer member; the outer member having a notch opening in its front end diametrically opposite said slot in the outer member; said outer member having a second elongate slot spaced rearwardly of said step part passing slot, and a laterally projecting handle securing to said inner member passing through said second slot.

7. The holder of claim 6 wherein said handle is a sleeve having a locking pin telescopically received therein, said inner sleeve having opposed pin openings and said pin extending through said opposed pin openings in said inner member to engage the outer member, there being a spring in said handle normally urging said pin into engagement with the outer member.

8. The holder of claim 7 wherein said handle has a portion of greater girth than the width of said second slot and said second slot has an enlarged opening at its rear end portion for receiving said portion of the handle, said spring normally retaining said portion of the handle in position within said enlarged slot opening to releasably lock the inner member in telescoped position relative to the outer member.

9. The holder of claim 8 wherein a handle surface is provided on the rear end of the outer member.

10. The holder of claim 9 wherein said handle surface is a slip on handle grip.

11. In combination with a tree step for retaining and applying a tree step with a step part and an oppositely extending tree penetrating part connected by a web comprising: a holder assembly comprising inner and outer telescopically coupled members mounted for axial movement relatively from a load position in which the inner member extends telescopically forwardly of the outer member for loading of the tree step to the inner member to a telescopically rearward retention position in which the tree step is captured by the outer member; the inner member having a wall portion with an axially elongate passage for receiving the web and an opposed wall portion for retaining the web with an opening passing the step part; the outer member having an axially elongate step part passing passage in alignment with said opposed wall portion extending to the front end of said outer member.

12. The tree step holder assembly of claim 11 wherein handle surface on said inner sleeve facilitates relative telescoping movement of said inner and outer members.

13. The tree stem holder assembly of claim 11 wherein said outer sleeve has an elongate second passage and said handle surface projects laterally therethrough.

14. The holder of claim 11 wherein the outer member has a notch opening in its front end diametrically opposite said slot in the outer member.

15. In combination with a tree step having a step part and a tree penetrating part connected by a web to extend in opposite lateral directions, a releasable tree step holder-applicator comprising inner and outer members moveable relatively from a load position in which the inner member extends forwardly of the outer member and is configured to receive the web and to pass the step part through it for loading of the tree step to the inner member to a retention position in which the tree step is captured and retained by the outer member; the said outer member having an elongate slot in alignment with said web extending to the front end of said outer member for slidably passing the tree step part; said outer member having a second elongate slot spaced rearwardly of said step part passing slot; a laterally extending handle securing to said inner member having a step passing through said second slot, said handle having a portion of greater girth than the width of said second slot and the second slot having an enlarged opening at its rear end for receiving said portion of greater girth of the handle, and a spring normally retaining said portion of greater girth of the handle in position within said enlarged slot opening in the retention position of the said members to releasably lock the inner member in telescoped position relative to the outer member.

16. The combination of claim 15 wherein said handle is a sleeve having a locking pin slidably received therein, said inner sleeve having opposed pin openings and said pin extending through said opposed pin openings in the said inner member to engage the outer member, said spring normally urging said pin into engagement with the outer member.

* * * * *